US006439661B1

(12) United States Patent
Bräuning

(10) Patent No.: US 6,439,661 B1
(45) Date of Patent: Aug. 27, 2002

(54) CHAIR MECHANISM

(75) Inventor: Egon Bräuning, Weil am Rhein (DE)

(73) Assignee: Vitra Patente AG, Muttenz (CH)

( * ) Notice: Subject to any disclaimer, the term of this patent is extended or adjusted under 35 U.S.C. 154(b) by 0 days.

(21) Appl. No.: 09/554,380

(22) PCT Filed: Oct. 20, 1999

(86) PCT No.: PCT/IB99/01720

§ 371 (c)(1),
(2), (4) Date: May 12, 2000

(87) PCT Pub. No.: WO00/22961

PCT Pub. Date: Apr. 27, 2000

(51) Int. Cl.[7] ..... A47C 1/024

(52) U.S. Cl. ..... 297/300.2; 297/300.4; 297/316

(58) Field of Search ..... 297/300.2, 300.4, 297/300.6, 300.7, 300.8, 301.3, 301.5, 302.1, 302.3, 353, 325, 300.1, 316

(56) References Cited

U.S. PATENT DOCUMENTS

| | | | | |
|---|---|---|---|---|
| 4,198,094 A | * | 4/1980 | Bjerknes et al. | 279/300.7 X |
| 5,385,388 A | * | 1/1995 | Faiks et al. | 297/301.3 |
| 5,658,045 A | * | 8/1997 | Van Koolwijk et al. | 297/301.3 X |
| 5,725,276 A | * | 3/1998 | Ginat | 297/301.5 X |
| 5,964,503 A | * | 10/1999 | Inoue | 297/300.4 |

FOREIGN PATENT DOCUMENTS

| | | |
|---|---|---|
| CH | 629945 | 5/1982 |
| EP | 0114600 | 8/1984 |
| EP | 0592369 | 4/1994 |
| EP | 0839478 | 5/1998 |
| WO | 9203072 | 3/1992 |
| WO | 9220262 | 11/1992 |
| WO | 9325121 | 12/1993 |

* cited by examiner

*Primary Examiner*—Peter M. Cuomo
*Assistant Examiner*—Stephen Vu
(74) *Attorney, Agent, or Firm*—Selitto, Behr & Kim

(57) ABSTRACT

The chair mechanism is configured as a so-called synchronizing mechanism in order, in the case of an adjustment in inclination of the rear support (4), to achieve simultaneous, harmonic adjustment of the seat panel (8). The underframe is positioned on a height-adjustable pneumatic spring (13, 14). For the synchronized movement, use is made of a mechanical torsion spring, preferably a rubber spring, and a further mechanical spring, preferably a helical spring, is arranged parallel thereto, with accumulative effect in relation to the resistance of the torsion spring. The strength of the torsion spring can be adjusted. The positioning of the axes of rotation (A1–A4) is of considerable importance for the kinematics. The chair can be adjusted from an assembly position, where the springs can be inserted in a state in which they are relieved of stressing, via the vertical position into the inclined position. The most prominent advantages of the chair mechanism are the large opening angle between the seat panel (8) and backrest in the inclined position, the adjustable degree of stiffness, and the compliant seat shell.

20 Claims, 11 Drawing Sheets

Fig. 6A
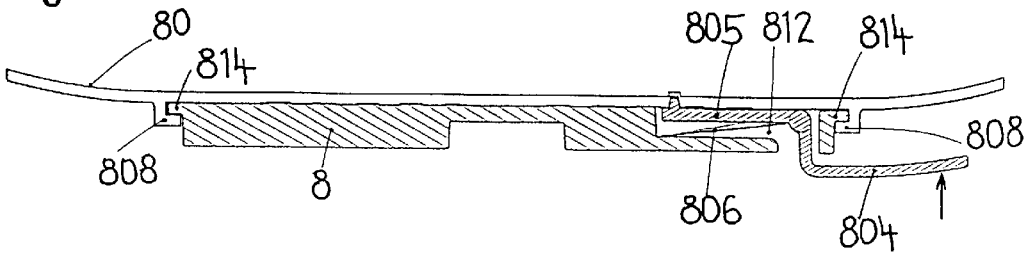
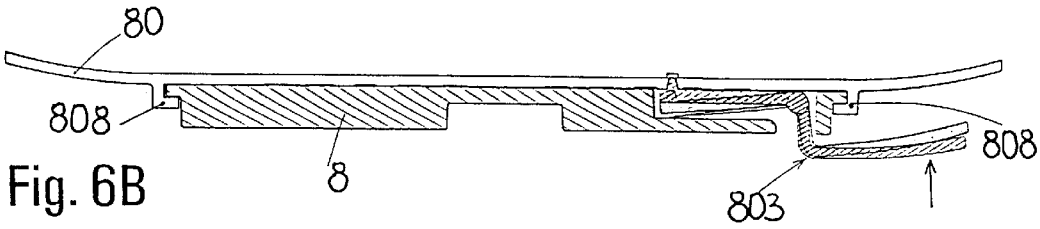
Fig. 6B
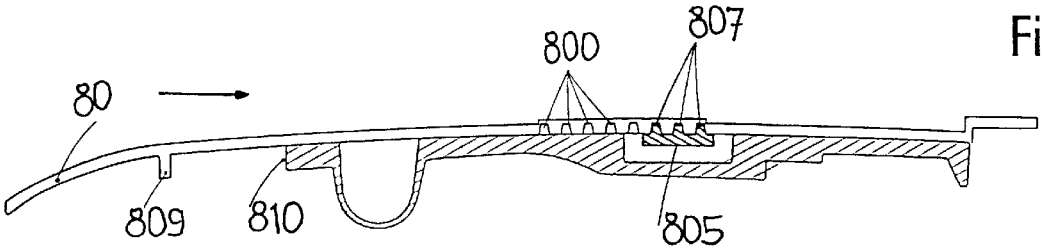
Fig. 6C
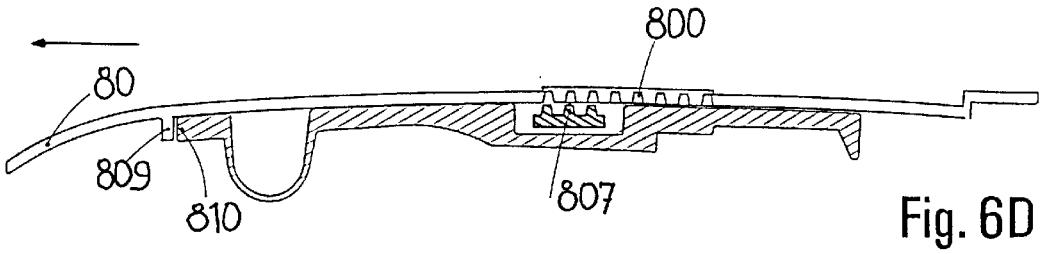
Fig. 6D

CHAIR MECHANISM

FIELD OF THE INVENTION

The invention relates to a chair mechanism, in particular for a rotatable office chair with a pneumatic spring which is arranged vertically in the under-frame and is intended for adjusting the height of the seat. The chair mechanism causes the seat panel to be lowered synchronously with the rearward inclination of the backrest, which the user initiates by shifting his/her weight.

BACKGROUND OF THE INVENTION

Office workers spend most of their working day in a sitting position. Staying in a writing position, in which the body is bent forward to a pronounced extent, over a number of hours at a computer workstation results in considerable straining of the skeleton, the muscles and the tissue of the back and the neck region. As a result, many attempts have been made to improve the geometry of chairs, and the mechanisms thereof, in order, in accordance with the respective sitting posture, to relieve the strain on the user more effectively. A decisive step in development was made by synchronizing mechanisms, where, with the adjustment of the backrest, via lever and articulation connections, the seat follows synchronously and, with each inclined position of the backrest, an ergonomically adapted position of the seat surface is established. Such a synchronizing mechanism is disclosed in CH-A-629 945. This mechanism allows the user to move out of the upright working position, by shifting his/her body weight in the rearward direction and applying pressure against the backrest, which is spring-mounted in a damped manner, into a rearwardly inclined, relaxing position, e.g. during a lengthy telephone call. The seat follows the inclining backrest, with the result that a rearwardly inclined, strain-relieved, resting position is achieved for the user. These chairs allow easy and frequent changeover into a relaxed user position.

It is usually the case, however, that office work can only be done in a forwardly bent position, rather than in a relaxed, rearwardly inclined position, in order to be in contact with the documents on the desk. In order to reduce the pressure of the seat against the lower leg and to force the user to straighten his/her spine, mechanisms in which, in the forwardly inclined position, the front seat surface is lowered as a result of the shift in weight are proposed. Moreover, attempts have been made, by specific shaping of the backrest with a lumbar support and at least simultaneous raising of the rear seat surface, to prevent the harmful rearward-rolling movement of the pelvis and a curved back. However, the backrest only provides support if one is seated properly in the chair and has definite contact with the backrest. In reality, the back region is not given support since one is usually seated in the vicinity of the front edge of the chair. EP-B-0 592 369 has thus proposed a synchronizing mechanism where, in the case of forwardly bent and upright sitting positions, the seat is lowered in the forward direction and, in the case of a shift in weight, the user slides into a rearwardly inclined, relaxing position.

The springs used are of critical importance for the functioning of a chair mechanism. In order to execute the synchronized movement between the backrest and seat panel, use is frequently made of pneumatic compression springs which, in order to improve the kinematics, are often coupled to helical compression springs (e.g. CH-A-629 945). However, pneumatic compression springs involve a number of disadvantages: they increase the cost for the overall chair to a considerable extent and, in order to achieve a favorable movement sequence, have to be coupled to mechanical springs, which further increases the cost and complexity of the design. Furthermore, the wear on the seals means that pneumatic compression springs only have a limited service life. WO-A-92/03072 has thus proposed using a mechanical spring in the form of a torsion bar for the spring mounting during the synchronized movement.

WO-A-93/25121 proposes using a rubber spring with an embedded steel core and an outer steel casing, the inner steel core being subjected to torsion. In the normal position of the seat, the use of such a rubber spring provides too low a level of stiffness, as a result of which this sitting position does not have the full amount of stability desired. This is not improved in any way by the envisaged positioning of the axes of rotation, i.e. an approximately central, rocker-like suspension of the seat panel and the articulation of the seat panel in the rear region.

OBJECT OF THE INVENTION

With the number of computer workstations constantly increasing, one is increasingly forced into an upright sitting position, with the neck region permanently tensed, in order to view the screen. This means a change in the typical working position for many people and, consequently, different requirements have to be met by the mechanisms of a chair in order to optimize the kinetic behavior of the latter. The prior-art synchronizing mechanisms are advantageous for users whose work allows them to change position frequently, namely between forwardly bent, upright and rearwardly inclined sitting positions. However, the known designs are still not ideal for individuals who have to sit permanently at a computer workstation.

The object of the invention is thus to provide a mechanism which provides, as a permanent working position, a rearwardly inclined sitting position in which the body is largely free of strain and which has a wide opening angle between the seat surface and rear surface. In the front sitting position, it is necessary to realize effective support for the lumbar region, while, in the rearwardly inclined sitting position, partial sinking into the chair is intended to provide a relaxed sitting position without the eye-contact angle having to be changed to any significant extent. In the relaxed, rearwardly inclined sifting position, the mechanism and the overall chair construction are intended simultaneously to allow a certain capacity for movement, and to provide noticeable support for the shoulders, for the user in the chair. The seat and the backrest are intended to be height-adjustable. Also desired is the capacity for regulating the seat depth and the intensity of the lumbar support as well as an adjustable neck support. The intention is for the chair to be mass-producible efficiently and cost-effectively.

Finally, the design must correspond to current tastes.

SUMMARY OF THE INVENTION

The chair mechanism of the seat rests on an underframe with a base—usually a standard five-armed star-shaped base—which is positioned on the floor, and a vertically arranged pneumatic spring with a telescopically extendible piston rod for adjusting the height of the chair. The seat is positioned on the piston rod, by way of the seat support arranged at the bottom, as a structural unit. Extending through the seat support is the horizontal main axis of rotation with the torsion spring, preferably a rubber spring, positioned along the same. Acting on the torsion spring is the rear support which can be pivoted about the main axis of rotation, counter to the resistance of the torsion spring. The chair also has a seat panel for receiving a seat cushion, possibly with the interposition of a cushion support. The seat panel, on the one hand, is articulated on the rear support along a horizontal rear axis of rotation and, on the other hand, is connected to an articulation along a horizontal front axis of rotation. The articulation is connected to the seat support along a horizontal fixed axis of rotation. The rear support and seat panel execute synchronous changes in position as they are pivoted between a vertical position and an inclined position.

The essence of the invention is that provided parallel to the torsion spring, and with accumulative effect in relation to the resistance of the torsion spring, is a further mechanical spring. The parallel spring is preferably a helical spring which can be separated into two symmetrically arranged parts. Another factor which is critical for the properties of the mechanism is constituted by the positions of the axes of rotation, which are all located beneath the seat panel. The front axis of rotation—as connection between the seat panel and articulation—is provided in the vicinity of the front edge of the seat panel, it being possible for the front axis of rotation to be pivoted radially over part of a circle about the fixed axis of rotation—as connection between the articulation and seat support. The rear axis of rotation—as connection between the seat panel and rear support—is located in the vicinity of the rear edge of the seat panel, it being possible for the rear axis of rotation to be pivoted radially over part of a circle about the main axis of rotation. The main axis of rotation is positioned between and beneath the front and the rear axes of rotation.

The fixed axis of rotation should preferably be located above the plane of the main axis of rotation and, in the vertical position of the chair, the front axis of rotation should be more or less vertically above the fixed axis of rotation. In the maximum inclined position, the rear axis of rotation should be capable of being lowered at least into the vicinity of the plane of the main axis of rotation. In the vertical position of the chair, the front axis of rotation is arranged in front of the fixed axis of rotation, in relation to the main axis of rotation. Starting from this chair position, the ratio of the horizontal spacing between the fixed axis of rotation and main axis of rotation and between the main axis of rotation and the rear axis of rotation is in the region of 1:2. In the maximum inclined position, the seat panel assumes a sloping position in the region of 15°.

The actually conventional torsion spring comprises the inner steel core, the rubber layer which is firmly applied to the steel core, and the outer steel casing which is firmly applied to the rubber layer. Extending through the steel core, along the main axis of rotation, is a polygonal through-passage into which a polygonal carry-along rod of complementary profile is inserted. The carry-along rod has its outer ends positioned in the free ends of the rear support, the latter being designed in the form of a fork with two support arms and said free ends being provided with a polygonal socket. Fastened on the outer steel casing of the torsion spring is an adjustable drawing element for adjusting the prestressing of said spring.

The parallel spring is arranged along the front axis of rotation and is supported, as a helical spring, beneath the seat panel by way of one end, while the other end of the helical spring is fixed on a pretensioning bolt. The pretensioning bolt is located along the front axis of rotation, is firmly inserted into the articulation and is positioned rotatably in front articulation extensions provided on the underside of the seat panel. There are in each case two articulations, pretensioning bolts, helical springs and pairs of articulation extensions, arranged symmetrically in relation to the torsion spring.

The rear support, between its two support arms, has a bearing bushing which is arranged beneath the seat panel, through which the rear axis of rotation extends and on which, positioned on an axial rod, rear articulation extensions provided on the underside of the seat panel are articulated. Above the seat panel, the two support arms are combined in a U-shaped guide which serves for receiving a backrest in a height-adjustable manner. The seat support comprises first of all the central sleeve body, with the main axis of rotation running through it, for receiving the torsion spring. The sleeve body is adjoined at the rear by the plug-on flange with its conical bore which runs along the vertical axis and is intended for positioning on the piston rod of the pneumatic spring. The bearing flange adjoins the front of the sleeve body. Said bearing flange has a through-passage bore which runs along the fixed axis of rotation, parallel to the main axis of rotation, and is intended for receiving an axial rod on which the articulations are arranged, on either side of the bearing flange. The sleeve body has a cutout for fitting the drawing element on the outer steel casing of the torsion spring.

The backrest comprises first of all the bottom, base member for insertion into the guide on the rear support, and an upwardly extending central member which adjoins the base member. Two lumbar extension arms which extend out horizontally in arcuate form symmetrically between the base member and central member serve for retaining and tensioning a flexible back shell. Two supporting arms which open in the form of a Y extend out from the top of the central member. The free ends of the lumbar extension arms have through-passage bores for fastening a back shell, while the ends of the supporting arms are positioned in pockets provided on the back shell. An inclination-adjustable headrest may be fitted on the backrest. The tensioning of the back shell in the lumbar region can be adjusted in a variable manner by means of eccentrics arranged in the lumbar extension arms. The back shell is spanned by a covering to the full extent on the user side and partially on the rear side, a shaped pocket and quick-action closures being provided in order to fix the covering. The headrest can be adjusted to a desired setting angle and selectable height.

The essential advantages of the chair mechanism according to the invention lie in the large opening angle between the seat panel and backrest in the inclined position, the adjustable reaction capability of the chair when the user shifts his/her weight, and the flexible, compliant seat shell, with the result that it is possible to take up the relaxed inclined position as a permanent working position. The intensity-adjustable lumbar support, the selectable height adjustment of the backrest and a headrest which can be adjusted in a variable manner in terms of setting angle provide a high level of sitting comfort, which is particularly important when one is working with a keyboard and at computer workstations. In the inclined position, the front edge of the seat panel is lowered and the entire seat moves in the rearward direction to a considerable extent. The optimum seat level thus provides the user's body with effective support for his/her back and shoulders without eye contact with his/her screen being lost and the neck muscles being strained. The preferably mesh-like covering of the back shell—and possibly also of the head cushion and armrests—gives pleasant seat-climate conditions and a decorative effect.

BRIEF DESCRIPTION OF THE ATTACHED DRAWINGS

In the drawings:

FIGS. 6A to 6D show the functioning of the adjustment of the seat level;

FIG. 6A shows a section along line A—A from FIG. 3A with the actuating lever secured;

FIG. 6B shows the illustration according to FIG. 6A with the actuating lever released;

FIG. 6C shows a section along line B—B from FIG. 3A with the cushion support drawn forward to the maximum extent and the actuating lever secured; and FIG. 6D shows the illustration according to FIG. 6C with the cushion support pushed rearward to the maximum extent and the actuating lever released.

DETAILED DESCRIPTION OF THE INVENTION

Figure 1B:
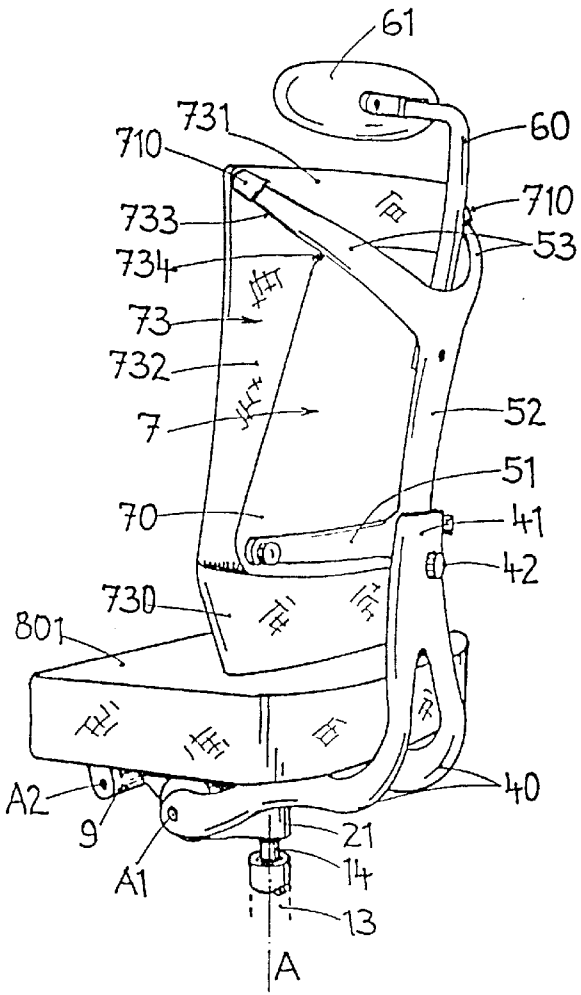
FIG. 1B shows the chair according to FIG. 1A in a perspective view from the rear.

The detailed description of an exemplary embodiment of the chair mechanism according to the invention is given hereinbelow with reference to the attached drawings.

The following applies to the rest of the description: if, in order to avoid ambiguity in the drawings, a figure contains designations which are not explained in the directly associated text of the description, then you are referred to the point at which they are mentioned in prior or subsequent figure descriptions. For reasons of clarity, components are not usually designated again in subsequent figures, provided that it is clear from the drawings that they are "recurring " components.

Figure 1A:
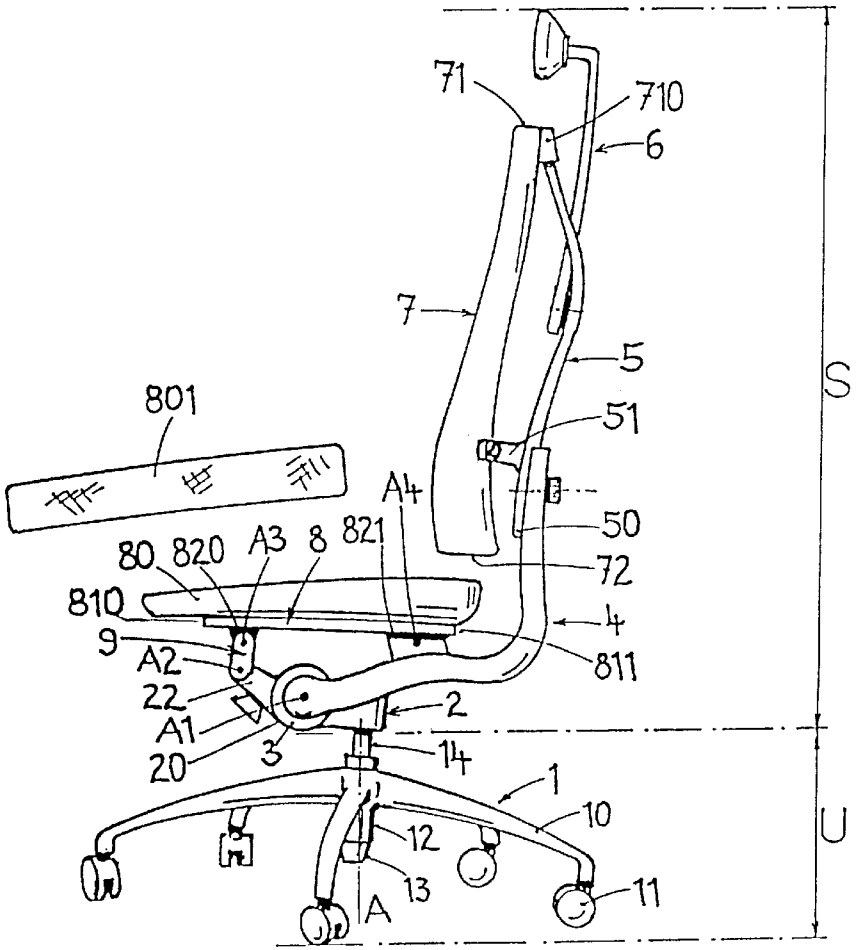
FIG. 1A shows a lateral perspective view of an entire chair according to the invention in the vertical position.
Figure 1C:
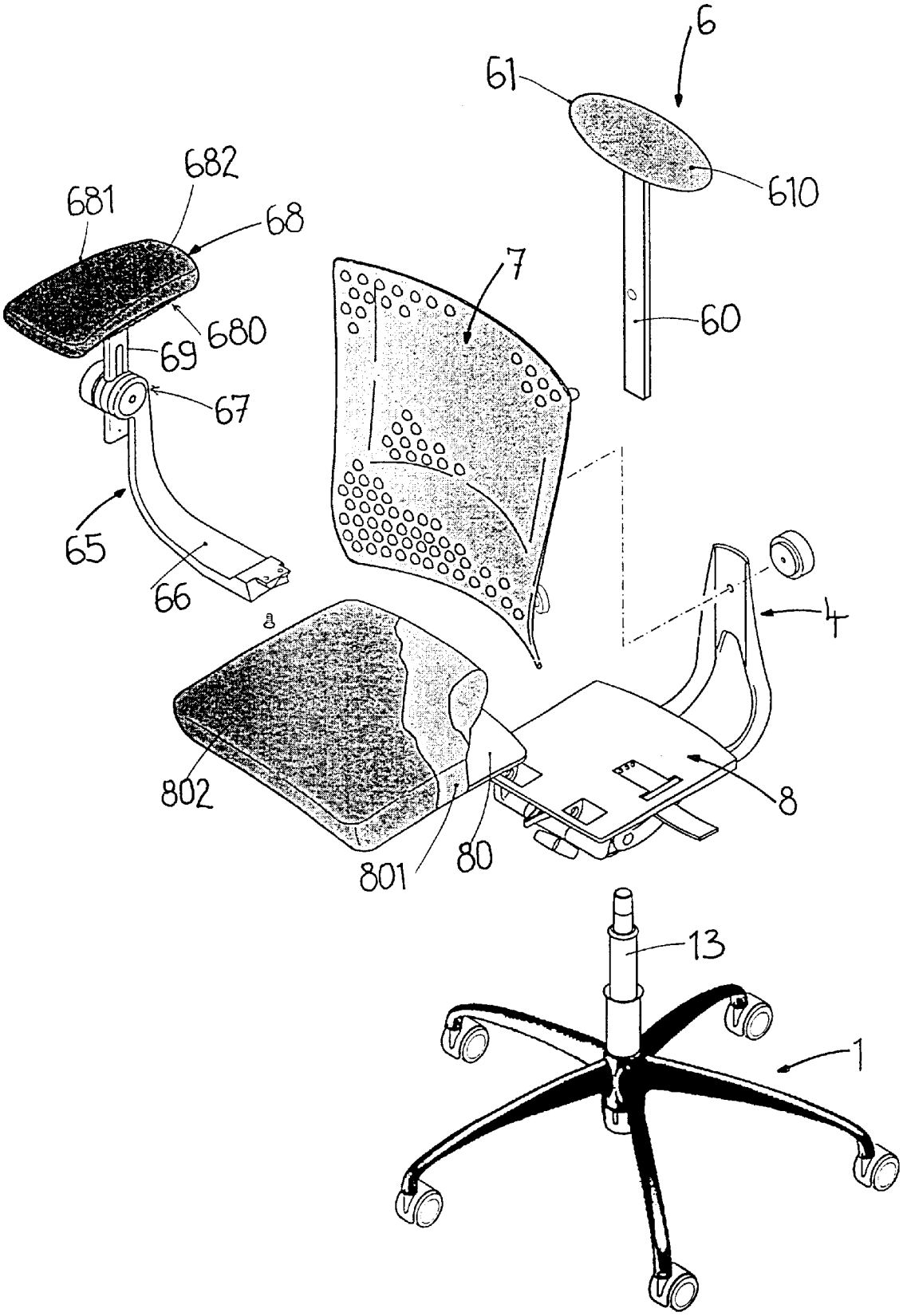
FIG. 1C shows the chair according to FIG. 1A as an exploded illustration in subassemblies with an armrest.
Figure 2A:
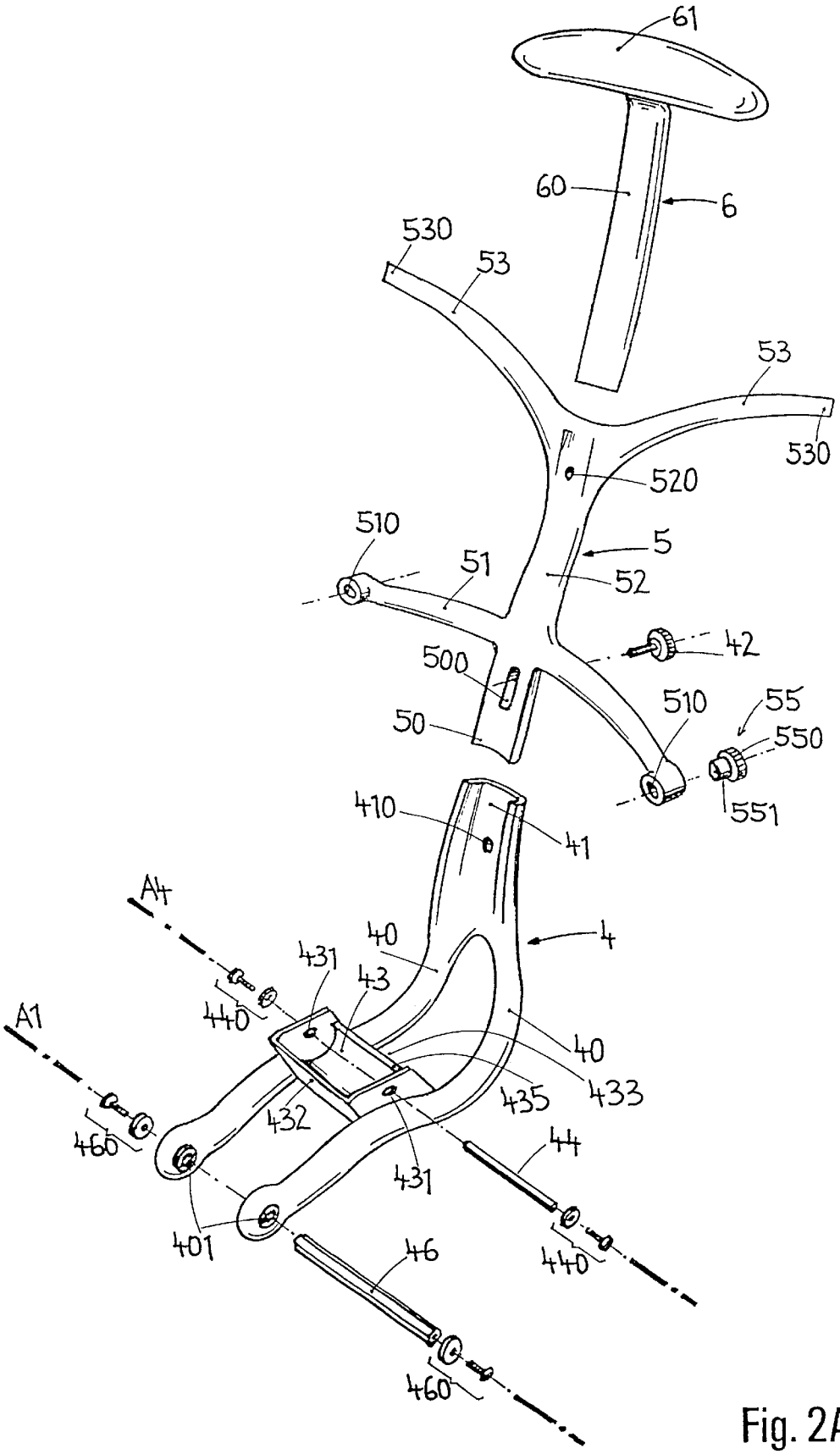
FIG. 2A shows an exploded illustration of a rear support, a backrest and a headrest.
Figure 2B:
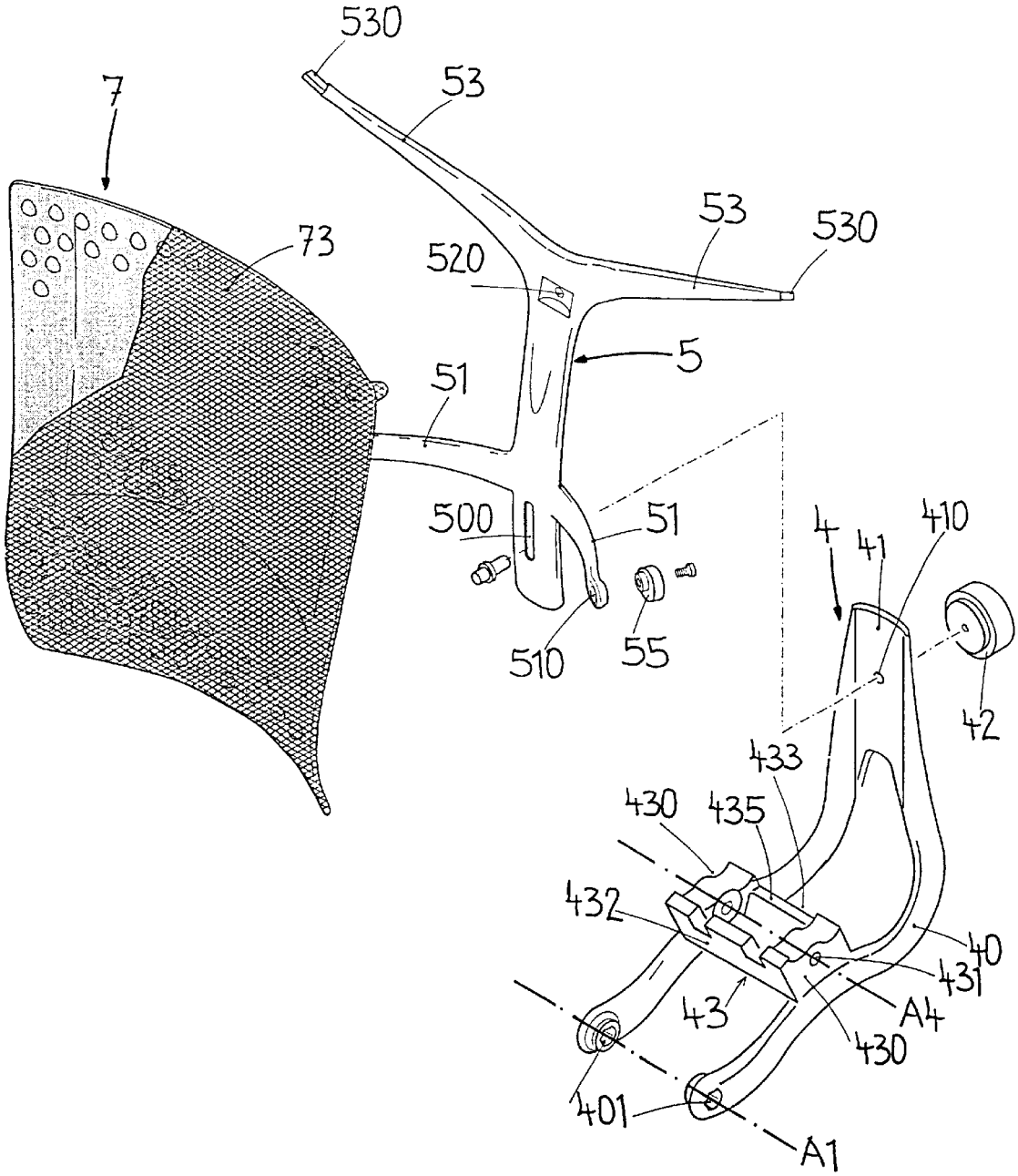
FIG. 2B shows the rear support and the backrest from FIG. 2A with a covered back shell.

FIGS. 1A and 1B

The chair as a whole is divided into two levels: the under-frame U, which is known per se, and the seat S, which is positioned on the under-frame U and embodies the invention. The under-frame U comprises a typical five-armed star-shaped base 1 with castors 11 which are attached to the ends of the arms 10 and are positioned on the floor. The center of the star-shaped base 1 is formed by a sleeve part 12 in which a pneumatic spring 13 is inserted vertically. A telescopically extendible piston rod 14 projects out of the pneumatic spring 13, along the axis A, and the seat support 2, which constitutes the basic part of the seat S as a whole, is positioned on said piston rod. It is possible for the seat S both to be rotated about the axis A and, with the extension and retraction of the piston rod 14, to be adjusted in terms of height along the axis A.

The seat support 2 comprises a central sleeve body 20, a rearwardly projecting plug-on flange 21 and a bearing flange 22 which adjoins at the front. Extending through the sleeve body 20 is the horizontal main axis of rotation A1, along which a conventional rubber spring 3 is received. The vertical axis A runs through the plug-on flange 21 and an axis of rotation A2, which is parallel to the main axis of rotation A1, runs through the bearing flange 22. The chair further comprises a rear support 4, a backrest 5, a headrest 6, a back shell 7, a seat panel 8 and the optionally attachable armrests (not illustrated). A cushion support 80 is arranged on the seat panel 8 in order to receive the seat cushion 801 directly. The seat support 2 along with the inserted rubber spring 3 are positioned beneath the seat panel 8, the main axis of rotation A1 being located more or less parallel to the front edge 810 of the seat panel 8.

Fastened along the main axis of rotation A1 is the rear support 4, which has its two support arms 40 adjoining the rubber spring 3 on either side in the form of a fork and extends upward in bent form from beneath the seat panel 8 at a spacing from the rear edge 811 of the seat panel 8. Above the level of the seat panel 8, the support arms 40 combine to form a guide 41 in which the height-adjustable backrest 5 is secured by way of its bottom, base member 50. The adjusted height is fixed by means of a clamping screw 42 which engages through the guide 41 of the rear support 4. Above the base member 50, two lumbar extension arms 51 extend out symmetrically, approximately horizontally and in arcuate form, and have their outer ends fastened on the back shell 7, in the bottom lumbar region 70 of the latter. The lumbar extension arms 51 enclose the lumbar region 70 of the back shell 7, and it would be possible to provide vertical extension slots in the lumbar region 70 in order to increase the elasticity of the back shell 7. Above the lumbar extension arms 51, the backrest 5 is in the form of a Y with a bottom, central member 52 and two supporting arms 53 which are spread out in a wing-like manner and of which the ends are positioned in pockets 710 which are located in the top corners of the rear side of the back shell 7. The vertical strut 60 of the headrest 6 is attached at the point where the supporting arms 53 branch off from the central member 52. Secured at the top of the vertical strut 60 is a head cushion 61 which is directed toward the rear of the user's head, it being possible for the inclination of the vertical strut 60 to be adjusted.

Arranged beneath the seat panel 8, in the vicinity of the front edge 810 and in the vicinity of the rear edge 811, are pairs of spaced-apart articulation extensions 820,821. Arranged on the bearing flange 22 of the seat support 2, along the axis of rotation A2 of the same, are articulations 9, which engage over the front articulation extensions 820 with the horizontal axis of rotation A3. Along a horizontal axis of rotation A4, the rear articulation extensions 821, which are located in the vicinity of the rear edge 811 of the seat panel 8, are each connected to a support arm 40 of the rear support 4. If the rear support 4 and backrest 5 are inclined in the rearward direction, the seat panel 8 is synchronously lowered and carried along in the rearward direction.

Provided for the purpose of covering over the back shell 7 is a covering 73 which, at the bottom, has a rearwardly directed pocket 730 which is open at the top. The bottom edge 72 of the back shell 7 is positioned in this pocket 730 approximately as far as the lumbar region 70. The covering 73 spans the front side of the back shell 7 to the full extent and has a top portion 731 for folding over the top edge 71 and two lateral portions 732 for folding over the two side edges of the back shell 7. Cutouts 733 run between the top portion 731 and the two lateral portions 732, with the result that, in the folded-over state, the pockets 710, which are provided on the back shell 7, remain accessible for positioning the ends 630 of the supporting arms 63. Provided between the top portion 731 and the respectively adjacent lateral portion 732 is a quick-action connection 734—e.g. a hook or touch-and-close connection—which engages beneath the supporting arms 53. It is also the case that the lateral portions 732 do not span those ends of the lumbar extension arms 51 which are fastened on the back shell 7, as a result of which the central area of the back shell 7 remains exposed at the rear. With the quick-action connections 734 released, the covering 73 can thus be quickly drawn onto the back shell 7 during assembly and likewise quickly removed for the purpose of cleaning or renewal.

FIG. 1C

The under-frame U with the star-shaped base 1 and the pneumatic spring 13, which is inserted vertically and centrally therein and is intended for adjusting the height of the seat S, can be seen in a state in which they have been dismantled into relatively large subassemblies. Of the seat S, it is possible to see the seat panel 8, beneath which the majority of the chair mechanism is located and the upwardly projecting rear support 4 is fastened. Positioned on the seat panel 8 is the cushion panel 80 which can be adjusted with the seat level and bears the seat cushion 801 and a covering 802 which spans the latter. Also depicted are the back shell 7 and the headrest 6 with the head cushion 61 and the downwardly extending vertical strut 60 for fastening on the backrest 5. It is practical and decorative for the head cushion 61 to be provided with a covering 610 which can be changed quickly, e.g. a mesh covering is effective from a visual point of view.

In order to finish off the chair, the latter may be equipped with laterally arranged armrests 65, of which the supporting arms 66, which are oriented upward in arcuate form, are preferably likewise fitted beneath the seat panel 8. At the top, the supporting arm 66 has an actuating device 67 for adjusting the height and the inclination of the armrests 68 positioned therein. The armrest 68 has a vertical support strut 69, projecting through the actuating device 67, a supporting plate 680 and the padding 681 arranged thereon. This padding 681 is preferably provided with a covering 682, e.g. likewise a decorative mesh covering.

FIG. 2A

Arranged between the two support arms 40, which adjoin the rear support 4 in the form of a fork beneath the guide 41, is a box-like bearing bushing 43 which is open at the top and in the two side walls 430—these butting against the support arms 40—of which there are provided two aligned bores 431 which are positioned along the axis of rotation A4. A front and a rear transverse wall 432,433 extend between the side walls 430. The rear articulation extensions 821, which extend from the seat panel 8, project into the bearing bushing 43. An axial rod 44 is pushed through the bores 431 in the bearing bushing 43 and complementary bores provided in the articulation extensions 821, with the result that the seat panel 8 is fastened rotatably on the rear support 4 along the axis A4. In order to fix the axial rod 44, use is made, for example, of in each case one lateral screw-connection 440 which is supported against the side walls 430 from the outside.

The front transverse wall 432 is directed toward the free ends of the support arms 40, through which the main axis of rotation A1 runs, while the rear transverse wall 443 is located opposite the front transverse wall 432 and is directed toward the guide 41 of the rear support 4. A depression 435 is made in the rear transverse wall 433 from above in order to receive a pretensioning wedge 45 (see FIG. 3B), of which the function will be explained at a later stage in the text. Along the main axis of rotation A1, the free ends of the support arms 40 each have a continuous polygonal socket 401, a polygonal-profile carry-along rod 46 being positioned in a rotationally stable manner through the two polygonal sockets 401 and the rubber spring 3. The carry-along rod 46 is fastened, for example, by in each case one screw-connection 460 which is supported laterally against the support arms 40 from the outside.

For the through-passage of the clamping screw 42, the U-profiled guide 41, which is open in the direction of the seat S, has a through-passage bore 410, and a slot 500 with a vertical extent is provided, to complement said through-passage bore, in the base member 50 of the backrest 5. The height adjustment of the backrest 5 can thus take place within the slot 500. The lumbar extension arms 51, which extend to both sides of the backrest 5, have through-passage bores 510 at their free ends. Provided for the interaction with the lumbar extension arms 51 are two eccentrics 55 which comprise a grippable turning knob 550, a cylinder portion 551, which can be inserted into the through-passage bores 510, and a tensioning bolt which projects eccentrically through the cylinder portion 551. Rotation of the eccentric 55 changes the spacing between the two tensioning bolts, and the tensioning in the lumbar region 70 of the back shell 7 can thus be adjusted. With more flexible tensioning, the lumbar region 70 of the back shell 7 becomes more elastically compliant for the user. The tensioning bolts engage in the back shell 7, with the result that the backrest 5 and back shell 7 can be firmly connected to one another.

Provided on the central member 52 of the backrest 5, in the vicinity of the point at which the supporting arms 53 branch off, is a screw hole 520 which serves for fastening the headrest 6. The free ends 530 of the supporting arms 53 could also have through-passage bores in order for it to be possible to insert screws for fastening on the back shell 7. However, the ends 530 are advantageously positioned in pockets 710 which are located on the rear side of the back shell 7, in the top corners.

FIG. 2B

For improved climatic conditions of the back shell 7, the latter is spanned by a decorative covering 73, e.g. a mesh, which can be changed quickly. The tensioning of the covering 73 means that, in the non-loaded state, said covering does not rest on the concavely curved back shell 7, as seen by the user, in the central region. The covering 73 thus lifts off from the back shell 7 as soon as the pressure applied by the user is eliminated. This allows both the back shell 7 and the covering 73 to breathe and give off any moisture received. Furthermore, a decorative visual effect is achieved. The side walls 430 of the bearing bushing 43 are contoured in ledge form, with the result that the supporting arm 66, of the armrest 65, positioned there is retained particularly well by way of positive locking and stops.

FIGS. 3A and 3B and 6A to 6D

This pair of figures serves merely for illustrating the construction of the chair mechanism and, in conjunction with the sequence of FIGS. 6A to 6D, for describing the actuating device for the seat level. Arranged in the seat panel 8 is a lever 803 which is angled twice and of which the grip part 804 projects laterally for actuation by the user and of which the plate-like securing part 805 comes to rest in a cutout 812 of the seat panel 8. Seated beneath the securing part 805 is a spring tongue 806 which is supported on the seat panel 8 and thus presses the securing part 805 in the upward direction with prestressing. Seated on the securing part 805 are three noses 807 which project upward in a row and are intended for engaging in a complementary grid arrangement of holes 800 beneath the cushion support 80 (see FIGS. 6A to 6D). With actuation of the lever 803, the noses 807 and the grid arrangement of holes 800 are disengaged, with the result that the cushion support 80 can be displaced with the seat level in stages from a maximum forward position (see FIG. 6C) to a furthest-rearward position (see FIG. 6D). Such an adjustment range could cover, for example, 50 mm in 5 stages of 10 mm.

The seat panel 8 has laterally projecting edges 814 which are cut out at the bottom and beneath which the cushion support 80, positioned thereon, grips by way of angled-in claws 808 arranged on its underside, with the result that the cushion support 80 is guided, with the seat level, on the seat panel 8. In the front region, the cushion support 80 has, on its underside, a stop edge 809 which, in the case of the furthest-rearward position of the cushion support 80, strikes against the front edge 810 of the seat panel 8. Two spaced-apart stop protrusions 813 are provided on the top side of the seat panel 8, in the vicinity of the rear edge 811 thereof, for bounding purposes in the furthest-forward position, the cushion support 80 striking against said stop protrusions when it is drawn forward to the full extent (see FIGS. 3A and 3B).

Figure 3A:
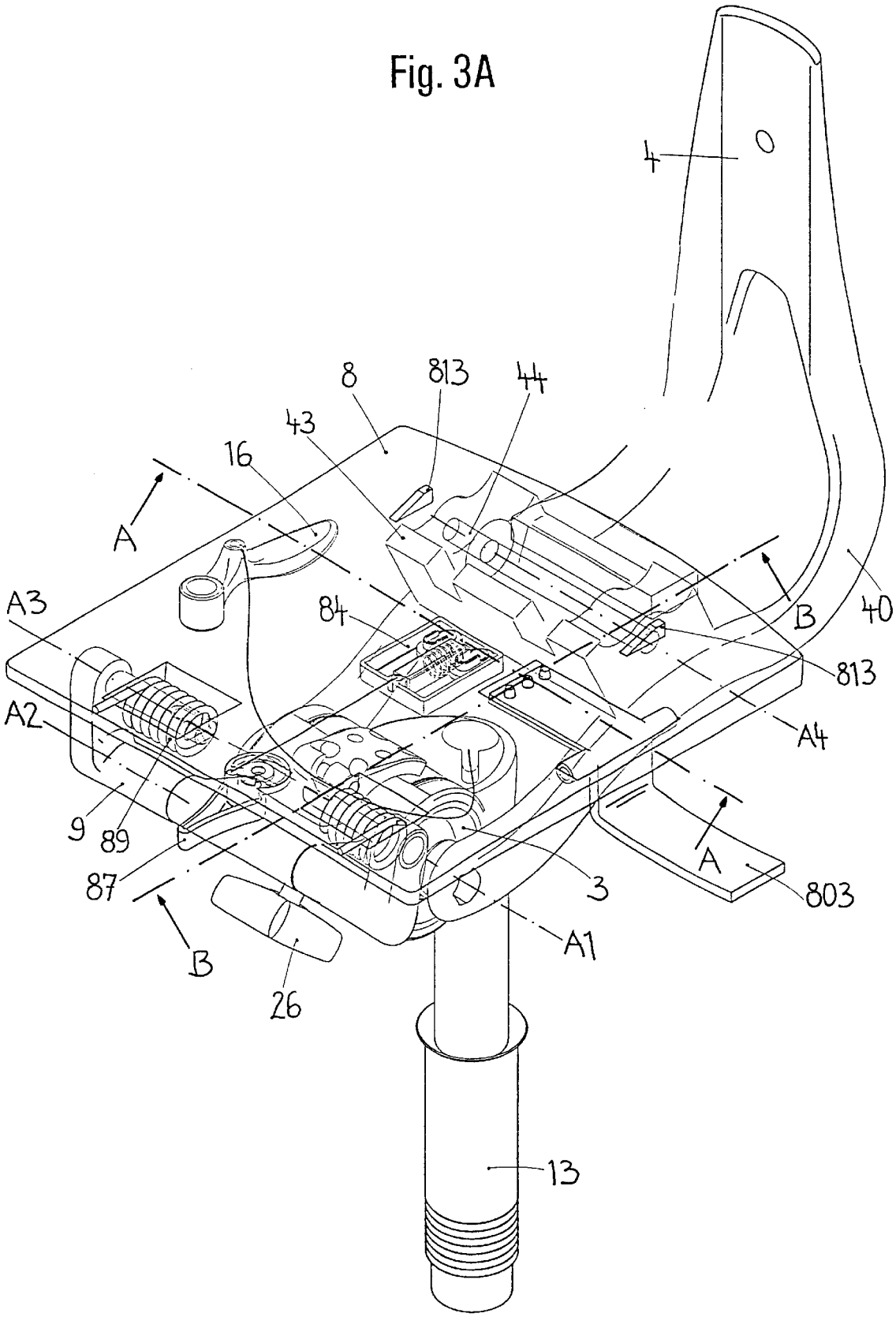
FIG. 3A shows the arrangement beneath the seat panel on the height-adjustment pneumatic spring with rear support.
Figure 3B:
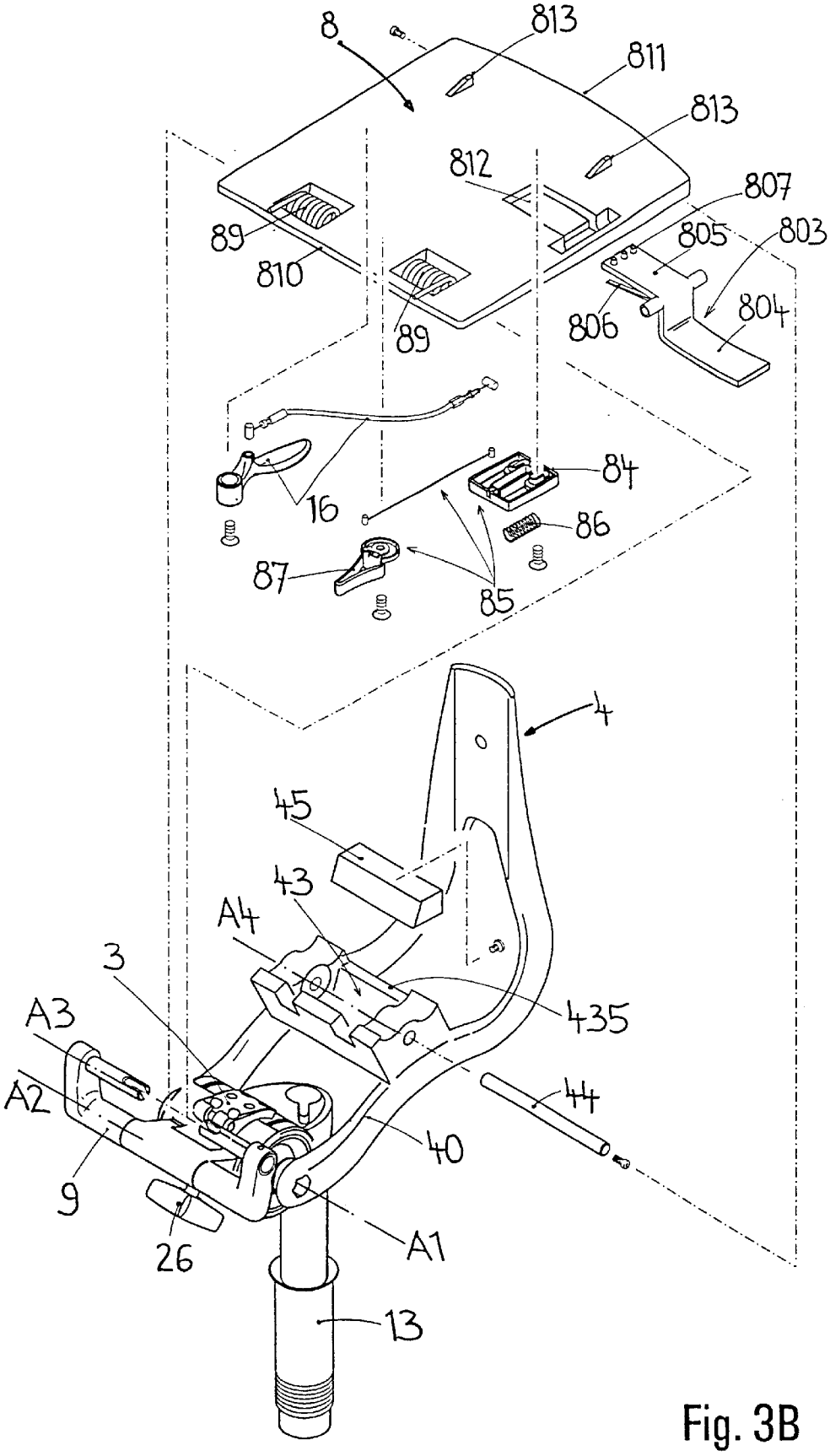
FIG. 3B shows the arrangement according to FIG. 3A as an exploded illustration.
Figure 3C:
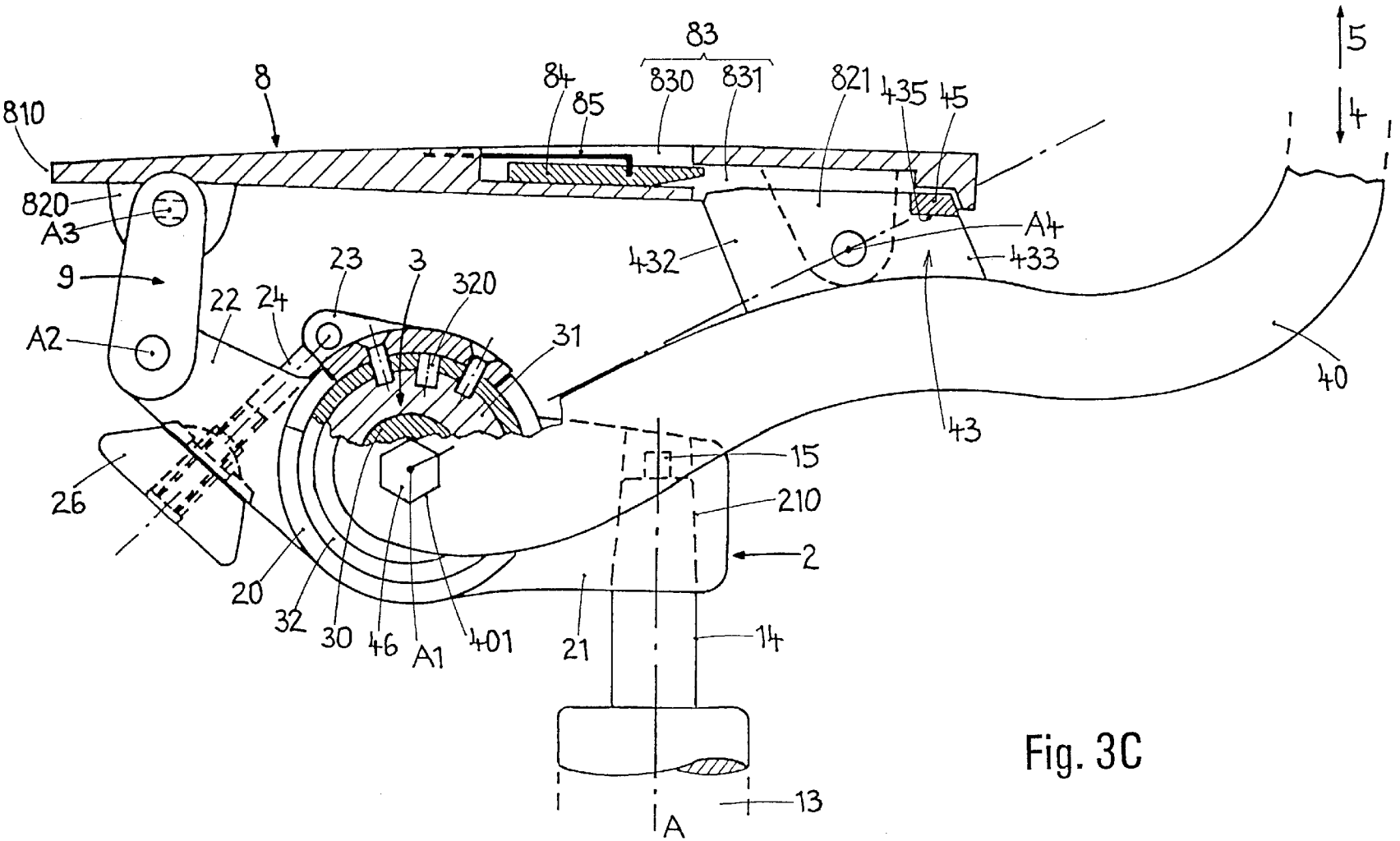
FIG. 3C shows, partially in section, the structural unit comprising rear support, seat panel and rubber spring positioned on the height-adjustment pneumatic spring, in the vertical position.
Figure 3D:
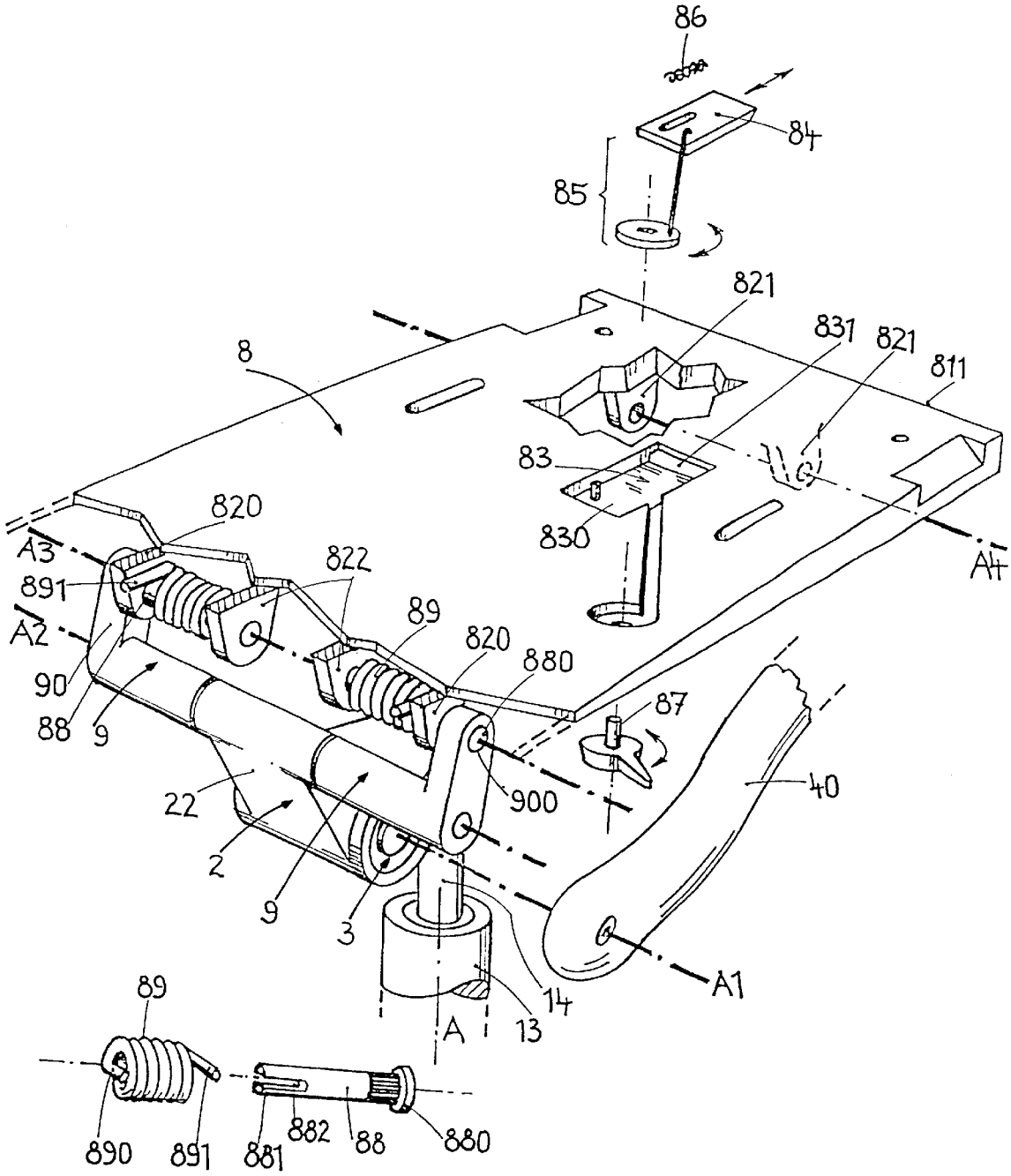
FIG. 3D shows a perspective view, partially in section, of the structural unit according to FIG. 3C.
Figure 4:
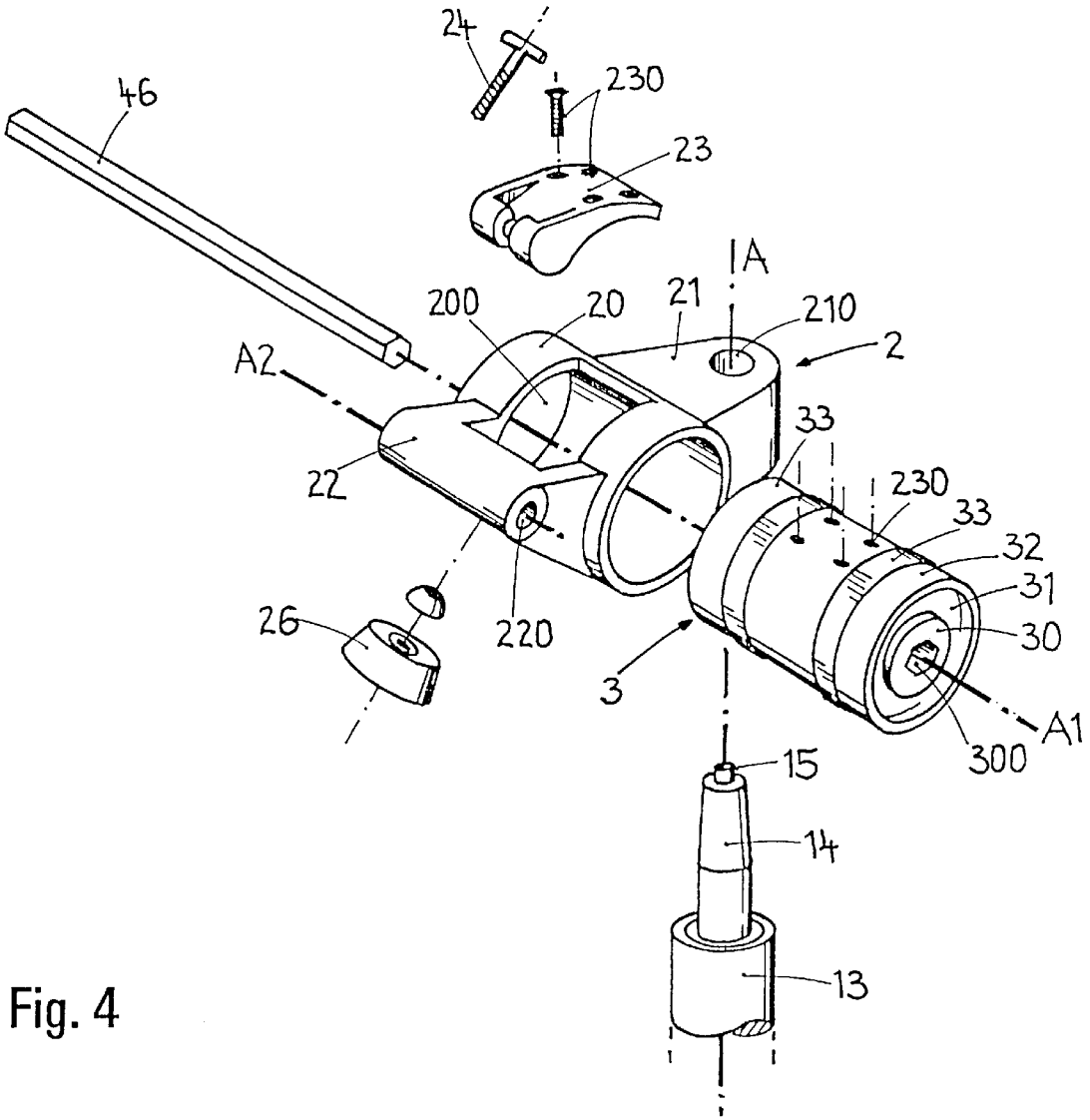
FIG. 4 shows an exploded illustration of the rubber spring with housing from FIG. 3A.

FIGS. 3C to 4

In relation to FIGS. 3A and 3B, the seat panel 8 according to FIGS. 3C and 3D is a simplified embodiment without the possibility of the seat level being adjusted. The rubber spring 3 is in the form of a roller and is of three-layered construction. An innermost steel core 30 has a polygonal—e.g. hexagonal—through-passage 300 which is located, along the main axis of rotation A1 and is intended for receiving the carry-along rod 46 in a positively locking manner. The carry-along rod 46 positioned in the rubber spring 3 is seated, on either side, in a rotationally stable manner in the polygonal socket 401 at the free end of the support arms 40. Applied to the steel core 30 is a rubber layer 31 which is enclosed by an outer seal casing 32. From the steel casing 32, carry-along elements 320 project into the rubber layer 31. Said rubber spring 3 is positioned in the sleeve body 20 of the seat support 2, it being possible for slide rings 33—e.g. made of plastic—to be applied to the steel casing in order to reduce the friction with the inner wall of the sleeve body 20. The plug-on flange 21, which is oriented in the rearward direction on the seat support 2, has, along the axis A, a vertical conical bore 210 in which the top portion of the piston rod 14, which can be extended from the pneumatic spring 13, is positioned. Projecting axially out of the piston rod 14 is the valve stem 15, the piston rod 14 retracting or extending upon actuation of the same, depending on the loading of the seat S. The valve stem 15 is actuated in a conventional manner via a switching lever (not illustrated), which is usually provided beneath the seat panel 8.

Arranged opposite the plug-on flange 21, oriented in the forward direction from the sleeve body 20, is the bearing flange 22, through which the through-passage bore 220 extends along the axis of rotation A2. Between the plug-on flange 21 and the bearing flange 22, the sleeve body 20 has a cutout 200 for the insertion of a drawing element 23 which is fastened on the outer steel casing 32, e.g. by a screw-connection 230. A drawing bolt 24 is fitted into the drawing element 23, the drawing bolt 24 projecting through the bearing flange 22, and a hand wheel 26 which is supported on the bearing flange 22 being screwed onto the drawing bolt 24. As the hand wheel 26 is screwed on, the drawing element 23 is drawn in the direction of the bearing flange 22 and the rubber spring 3 is thus prestressed further.

Arranged on either side of the bearing flange 22, along the axis of rotation A2, are the rotatable articulations 9, which engage over the axis of rotation A3 and are connected there in a rotatable manner to the front articulation extensions 820 on the underside of the seat panel 8. The articulation extensions 821 provided at the rear of the underside of the seat panel 8 are articulated in the bearing bushing 43, along the axis of rotation A4, said bearing bushing being seated between the support arms 40 of the rear support 4. The carry-along rod 46, which is positioned in the rubber spring 3, is seated, on either side, in a rotationally stable manner in the polygonal socket 401 at the free end of the support arms 40.

The seat panel 8 has a depression 83 comprising two sections 830,831. One depression section 830 is made from above and is located in front of the bearing bushing 43, as seen from the front edge 810 of the seat panel 8. Directly adjoining the depression section 830 is a depression section 831, which is made from beneath and is positioned above the bearing bushing 43, between the articulation extensions 821. It is thus possible to insert into the depression section 830 a locking slide 84 which, loaded by a spring 86, is always pushed partially into the depression section 831, with the result that the locking slide 84 is positioned on the front transverse wall 432 of the bearing bushing 43 such that it engages beneath the seat panel 8 (FIG. 3C shows the unlocked state). This means that the vertical position of the chair is secured. Even if the user applies substantial pressure against the backrest 5 and/or the rear support 4, the rear support 4 and the backrest 5 attached thereon remain in a prestressed, more or less vertical position. The locking slide 84 is adjoined by a restoring mechanism 85 which can be actuated by a switching lever 87 in order for the locking slide 84, if required, to be drawn back, counter to the action of the spring 86, into the unlocked position, which is shown in FIG. 3C. It is only then that the rear support 4 and backrest 5 can be moved in the rearward direction into the inclined position. The locking slide 84 remains, by passing beyond a dead-center position of the restoring mechanism 85, in the drawn-back state, i.e. the rear support 4 remains movable. The rear support 4 is prevented from pivoting forward about the main axis of rotation A1 when the seat S has been completely relieved of loading by the pretensioning wedge 45, which is placed in the depression 435 on the rear transverse wall 433 of the bearing bushing 43 and presses against the seat panel 8 from beneath.

It can also be seen in FIG. 3D that beveled sections are provided on either side in the vicinity of the rear edge 811 of the seat panel 8; the armrests are also attached here. Provided in relation to the two front articulation extensions 820 on the underside of the seat panel 8 which have been described hitherto are two further, inner articulation extensions 822, which are likewise located along the axis of rotation A3 and are each offset in the direction of the seat support 2, with the result that the articulation extensions 820 are located on the outside, and the two inner articulation extensions 822 are located opposite one another and are each spaced apart from the associated outer articulation extension 820. Provided on the outside of the outer articulation extension 820 in each case is an articulation 9 which has its articulation leg 90 oriented in the direction of the axis of rotation A3 and in which a through-passage bore 900 is located along the axis of rotation A3. Bores which are aligned with the through-passage bore 900 are likewise provided in the articulation extensions 820,822, located along the axis A3, as a result of which it is possible to insert as a spindle, along the axis of rotation A3, a pretensioning bolt 88 which extends from the articulation leg 90—with its head 880 firmly seated therein—through the two associated articulation extensions 820,822. At the shank end 881, the pretensioning bolt 88 has a transverse slit 882. Positioned on the inserted pretensioning bolt 88, between the pair of articulation extensions 820,822, is a helical spring 89, which has, at one end, a bent-over section 890 extending over the spring diameter and, at the opposite end, a tangential bent-over section 891. The tangential bent-over sections 891 of the two helical springs 89 each butt against the underside of the seat panel 8, while the bent-over sections 890, which extend over the spring diameter, are positioned in the transverse slit 882 of the pretensioning bolt 88.

Figure 5:
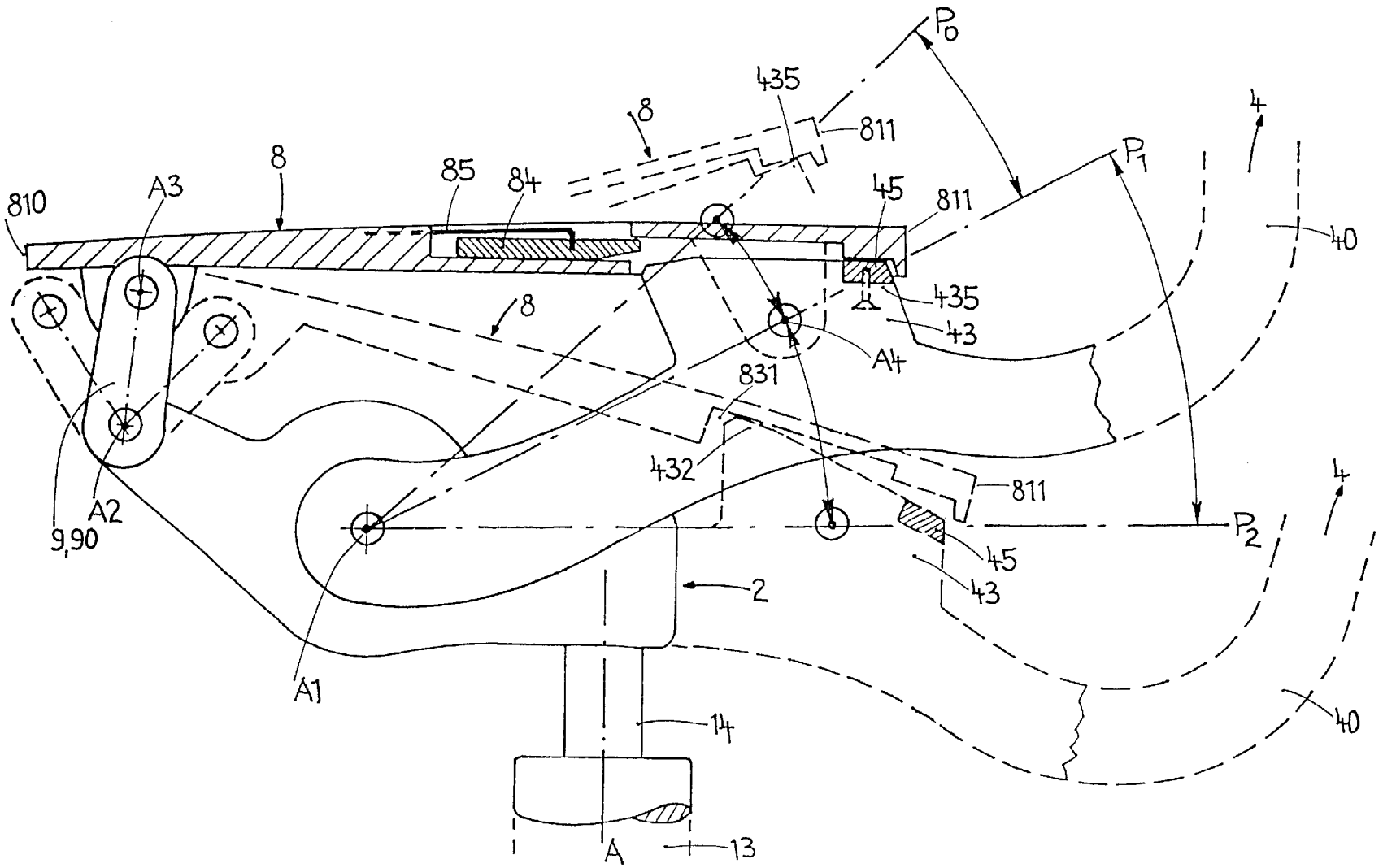
FIG. 5 shows the structural unit according to FIG. 3C in the movement sequence between the assembly position, via the vertical position, to the inclined position.

This means that the effect of the two helical springs 89 is added accumulatively to the effect of the rubber spring 3. A user who is sitting on the chair and whose body weight bears against the rear support 4 and/or the backrest 5—the locking slide 84 being drawn back, that is to say unlocked—is supported simultaneously by the effects of the rubber spring 3 and the helical springs 89. The rubber spring 3 and the helical springs 89 are arranged in parallel. When the rear support 4 is inclined in the rearward direction, the carry-along rod 46 rotates in the rubber spring 3, counter to the increasing action thereof, and the seat panel 8 is guided along synchronously at the same time, with the result that the helical springs 89 are increasingly rotated and subjected to stressing in the process. For adaptation to individual requirements, the overall spring resistance of the parallel arrangement comprising the helical springs 89 and the rubber spring 3 can be adjusted via the hand wheel 26, by means of which the position of the drawing element 23, and thus the prestressing of the rubber spring 3, is determined. FIG. 5

During the assembly of the chair, the pretensioning wedge 46 is not yet inserted into the bearing bushing 43, and the rear support 4 can thus be advanced in the forward direction, negatively as it were, about the fixed main axis of rotation A1, in the direction of the front edge 810 of the seat panel 8, into the assembly position $P_0$. The seat panel 8 follows this movement synchronously, the seat panel being lowered in the region of the front edge 810 and raised in the region of the rear edge 811. There is movement about the fixed axis of rotation A2, with lowering of the axis of rotation A3, and movement about the main axis of rotation A1, with the axis of rotation A4 being raised. In the assembly position $P_0$, the rubber spring 3 and the helical springs 89 can be assembled in a state in which they are relieved of stressing. In relation to one another, the fixed axis of rotation A2 is located above the level of the fixed main axis of rotation A1. The maximum negative setting angle is achieved when the depression 435 in the bearing bushing 43 strikes, by way of its top edge, against the underside of the seat panel 8 in the vicinity of the rear edge 811.

With the introduction of the pretensioning wedge 45, the chair is moved into the vertical position $P_1$, i.e. the backrest 5, which is fitted on the rear support 4, is located approximately vertically and the seat panel 8 is in an approximately horizontal position. Since they are fixed, the positions of the main axis of rotation A1 and of the axis of rotation A2 along the bearing flange 22 of the seat support 2 remain unchanged. In this case, however, the rubber spring 3 and the helical springs 89 are prestressed. By virtue of the backrest 5 being positioned vertically, the rear support 4 pivots about the main axis of rotation A1, as result of which the axis of rotation A4 is lowered. At the same time, the articulations 9 pivot about the axis of rotation A2 and the articulation legs 90 are positioned approximately vertically, with the result that the axis of rotation A3 is then located in a position in which it is raised at a slight extent vertically above the axis of rotation A2. The articulation legs 90 are preferably inclined to some extent in the vertical position $P_1$, with the result that the axis of rotation A3 is arranged in front of the axis of rotation A2, as seen in the direction of the main axis of rotation A1. This allows the user to move more comfortably into the inclined position $P_2$, by shifting his/her weight, without having to press against the backrest 5. It has also proven advantageous for the axis of rotation A4, which can be changed about the main axis of rotation A1, to be arranged in the vertical position $P_1$ such that the axis of rotation A4, which is located in the vicinity of the rear edge 811 of the seat panel 8, comes to rest above the main axis of rotation A1 and axis of rotation A2, but is located beneath the axis of rotation A3. Return into the assembly position $P_0$ by a negative setting angle is ruled out since the top edge of the introduced pretensioning wedge 45 strikes against the underside of the seat panel 8 in the vicinity of the rear edge 811.

With the user shifting sufficient weight, the drawn-back locking slide 84 allows the seat S to be adjusted into the inclined position $P_2$. In this case, the rear support 4 rotates about the main axis of rotation A1, and the axis of rotation A4 is lowered at maximum to level with the main axis of rotation A1. At the same time, the articulations 9 pivot about the axis of rotation A2, with the result that the articulation legs 90 are inclined in relation to the main axis of rotation A1, and the axis of rotation A3 has advanced both horizontally and vertically toward the main axis of rotation A1, but is still located above the two axes of rotation A1 and A2. The maximum inclination of the seat S in the inclined position $P_2$ is bounded by the seat panel 8 being positioned on the front transverse wall 432 of the bearing bushing 43 in the region of the bottom depression section 831, and this acts as a stop in the end position.

What is claimed is:

1. A mechanism for a chair, comprising an underframe with a base, which is positioned on the floor, and a pneumatic spring having a telescopically extendible piston rod which defines a vertical axis extending therealong and is for adjusting the height of the chair, and a seat with a seat support which supports the bottom of the seat and is mounted onto the piston rod, the improvement comprising:

a seat panel for receiving a seat cushion, said seat panel having a front edge at one end thereof and a rear edge at an opposite end thereof;

a horizontal main axis of rotation positioned at a predetermined height relative to and underneath said seat panel and extending through the seat support in a direction substantially parallel to said front edge of said seat panel and along which there is arranged a mechanical torsion spring, which is adjoined by a rear support which is pivotable about said main axis of rotation counter to a resistance created by the torsion spring when the seat is moved from a vertical position to an inclined position;

one end of said seat panel being articulated to the rear support along a horizontal rear axis of rotation which is proximate to said rear edge of said seat panel and extends in a direction substantially parallel to said front edge of said seat panel and the opposite end of said seat panel being connected to an articulation along a horizontal front axis of rotation which is proximate to said front edge of said seat panel and extends in a direction substantially parallel to said front edge, said articulation being connected to said seat support along a horizontal fixed axis of rotation which has a fixed position relative to said main axis of rotation, said fixed axis of rotation being proximate to said front edge of said seat panel and extending in a direction substantially parallel to said front edge, whereby, when the rear support is pivoted between a vertical position and an inclined position of the chair, a synchronous change in position of said seat panel occurs wherein a second mechanical spring provided parallel to said torsion spring produces an accumulative effect in relation to the resistance of said torsion spring and said main, said fixed, said front and said rear axes of rotation are positioned beneath said seat panel such that said front axis of rotation is at least partially pivotable about said fixed axis of rotation;

said rear axis of rotation is at least partially pivotable about said main axis of rotation;

said main axis of rotation is positioned between and beneath said front and said rear axes of rotation said fixed axis of rotation is located above a horizontal plane that is positioned at the same height as said main axis of rotation;

in the vertical position of the chair, said front axis of rotation is located substantially vertically above said fixed axis of rotation; and in a maximum inclined position, said rear axis of rotation is lowered at least into proximity with said horizontal plane positioned at the same height as said main axis of rotation.

2. The chair mechanism as claimed in claim 1, wherein in the vertical position of the chair, said front axis of rotation is positioned in front of said fixed axis of rotation, relative to said main axis of rotation;

in the vertical position of the chair, the ratio of the horizontal spacing between said fixed axis of rotation and said main axis of rotation and the horizontal spacing between said main axis of rotation and said rear axis of rotation is approximately 1:2; and in the maximum inclined position, said seat panel is positioned at an angle of about 15 degrees relative to and above the horizontal plane positioned at the same height as said main axis of rotation.

3. The chair mechanism as claimed in claim 1, wherein said second mechanical spring is a helical spring positioned along said front axis of rotation, one end of said helical spring being supported beneath said seat panel and the other end of said helical spring being fastened on a pretensioning bolt;

said pretensioning bolt is located along said front axis of rotation, firmly inserted into said articulation and positioned rotatably in front articulation extensions that are provided on the underside of said seat panel; and the chair mechanism further comprises two of said articulations, two of said pretensioning bolts, two of said helical springs and two of said articulation extensions, all of which are positioned symmetrically on either side of said torsion spring.

4. The chair mechanism as claimed in claim 1, wherein a locking slide, which is loaded by a spring, is provided in said seat panel for securing the chair in its vertical position.

5. The chair mechanism as claimed in claim 1, wherein a lever is provided in said seat panel for adjusting the level of the seat, said lever being retained against a cushion support by pressure exerted by a spring element; and securing elements are provided on said lever and a grid arrangement is provided beneath said cushion support, said grid arrangement being complementary to said securing elements, said grid arrangement and said securing elements being in engagement with one another in a non-actuated state, thereby blocking displacement of said cushion support, and also being disengagable from one another, counter to said pressure of said spring element.

6. The chair mechanism as claimed in claim 5, wherein said spring element is a spring tongue extending from said lever and supported on said seat panel;

said securing elements are upwardly projecting noses;

said grid arrangement includes a row of holes that facilitate a plurality of stages of adjustment;

a maximum front position and a maximum rear position of said cushion support are defined by stops that are provided on said seat panel and said cushion support; and said cushion support has an underside with angled-in claws and said seat panel has side borders with laterally projecting edges, said angled-in claws being complementary to said laterally projecting edges, whereby said cushion support is guided on said seat panel.

7. The chair mechanism as claimed in claim 1, wherein said torsion spring has a pretension and comprises an inner steel core, a rubber layer firmly affixed to said steel core, and an outer steel casing firmly affixed to said rubber layer;

a polygonal through-passage extends through said steel core along said main axis of rotation and a carry-along rod having a complementary polygonal profile said carry-along rod is inserted through said polygonal through-passage;

the rear support has two support arms forming a fork, each of said support arms having a free end with a polygonal socket, said carry-along rod having its outer ends positioned in said sockets; and an adjustable drawing element for adjusting the pretension of said torsion spring is fastened on said outer steel casing.

8. The chair mechanism as claimed in claim 1 or 7, wherein said seat support comprises:

a central sleeve body, through which said main axis of rotation extends, for receiving said torsion spring, a plug-on flange attached to a rear portion of said sleeve body and having a conical bore which extends along said vertical axis and which is positioned on the piston rod, and a bearing flange attached to a front portion of said sleeve body and having a through-passage bore extending along said fixed axis of rotation and parallel to said main axis of rotation, said through-passage bore receiving an axial rod therethrough, on which a pair of said articulations are positioned on either side of said bearing flange; wherein said sleeve body has a cutout for fitting said adjustable drawing element on said outer steel casing of said torsion spring.

9. The chair mechanism as claimed in claim 1 or 7, wherein the rear support includes a bearing bushing positioned between said two support arms and beneath said seat panel, said rear axis of rotation extending through said bearing bushing, said bearing bushing including an axial rod, said seat panel being provided with rear articulation extensions on the underside thereof that are articulated on said axial rod; and said two support arms form a guide above said seat panel for attaching a backrest thereto in a height-adjustable manner.

10. The chair mechanism as claimed in claim 9, wherein said backrest comprises a bottom, base member for insertion into said guide on the rear support, an upwardly extending central member having a top and being connected to said base member, two lumbar extension arms which extend horizontally and symmetrically between said base member and said central member for securing and tensioning an elastic back shell, said two lumbar arms each having an acruate shape and a free end, and two supporting arms which extend from said top of said central member forming a Y shape;

said free end of each of said two lumbar extension arms having a through-passage bore for fastening said back shell thereto;

each of said two supporting arms having a free end, said back shell having a rear side with two pockets, said free end of each of said two supporting arms being received into a corresponding one of said two pockets; and a headrest having adjustable inclination and adjustable height is fastened on said backrest.

11. The chair mechanism as claimed in claim 10, wherein rotatable eccentrics are inserted into said through-passage bores of said free ends of said two lumbar extension arms for variably tensioning said back shell in a lumbar region thereof and said rotatable eccentrics have eccentrically positioned tensioning bolts that engage said back shell to facilitate said tensioning of said back shell.

12. The chair mechanism as claimed in claim 11, wherein each of said eccentrics has a turning knob which is connected to a coaxial cylinder portion that is inserted into a corresponding one of said through-passage bores;

each of said eccentrically arranged tensioning bolt projects through said eccentric; and each of said tensioning bolts serves simultaneously as a retaining screw which engages in said back shell.

13. The chair mechanism as claimed in claim 10, wherein said back shell is made of an elastically compliant material.

14. The chair mechanism as claimed in claim 13, further comprising a covering that is semitransparent and spans said back shell on a surface thereof that is contacted by a user, said covering lifting off partially from said surface when in a non-loaded state, thereby improving the seat-climate conditions, said covering having a bottom portion with a pocket which is open at the top for receiving a bottom portion of said back shell therein, said covering having a top portion for folding over a top edge of said back shell. said covering having lateral portions for folding over side edges of said back shell;

a cutout provided between said top portion and each of said lateral portions of said covering for the insertion of said two supporting arms therethrough allowing each of said two supporting arms to be fastened to said back shell; and a quick-action closure provided between said top portion and each of said lateral portions, each of said quick-action closures engaging beneath a corresponding one of said two supporting arms.

15. The chair mechanism as claimed in claim 14, wherein said covering of said back shell is mesh.

16. The chair mechanism as claimed in claim 11, wherein said headrest includes a vertical strut and a head cushion; said vertical strut of said headrest is fastened to said backrest by a securing element; and said head cushion has a semi-transparent covering.

17. The chair mechanism as claimed in claim 16, wherein said covering of said head cushion is mesh.

18. The chair mechanism as claimed in claim 10, wherein said back shell includes top corners and said pockets are located in said top corners.

19. The chair mechanism as claimed in claim 10, wherein said back shell includes a lumbar region having extension slots.

20. The chair mechanism as claimed in claim 10, wherein a covering covers said back shell at least on the side of said back shell that is contacted by a user.

* * * * *